US008526843B2

(12) United States Patent
Terai et al.

(10) Patent No.: US 8,526,843 B2
(45) Date of Patent: Sep. 3, 2013

(54) CLEANING ELEMENT FOR AN IMAGE-FORMING APPARATUS, CHARGING DEVICE, PROCESS CARTRIDGE AND IMAGE-FORMING APPARATUS

(75) Inventors: Yuji Terai, Kanagawa (JP); Makoto Nishimura, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 529 days.

(21) Appl. No.: 12/915,635

(22) Filed: Oct. 29, 2010

(65) Prior Publication Data

US 2011/0318045 A1 Dec. 29, 2011

(30) Foreign Application Priority Data

Jun. 28, 2010 (JP) ..... 2010-146760

(51) Int. Cl.
*G03G 15/02* (2006.01)

(52) U.S. Cl.
USPC ..... 399/99; 399/100

(58) Field of Classification Search
USPC ..... 399/99–101, 123, 357
See application file for complete search history.

(56) References Cited

U.S. PATENT DOCUMENTS 5,610,691 A 3/1997 Takahashi et al.

FOREIGN PATENT DOCUMENTS

| | | |
|---|---|---|
| JP | A-8-137208 | 5/1996 |
| JP | A-8-166705 | 6/1996 |
| JP | A-9-222776 | 8/1997 |
| JP | A-11-143183 | 5/1999 |
| JP | A-2001-209238 | 8/2001 |
| JP | A-2005-24675 | 1/2005 |
| JP | A-2006-276404 | 10/2006 |
| JP | A-2008-96822 | 4/2008 |

*Primary Examiner* — David Gray
*Assistant Examiner* — Laura Roth
(74) *Attorney, Agent, or Firm* — Oliff & Berridge, PLC

(57) ABSTRACT

A cleaning element for an image-forming apparatus, includes: a shaft; a strip-shaped sheet which is disposed helically on an outer circumferential surface of the shaft; and an adhesive layer which is disposed between the shaft and the strip-shaped sheet and binds the shaft and the strip-shaped sheet, the strip-shaped sheet having, on a surface thereof facing the shaft, an unbound region in which the adhesive layer is absent, at an end in a width direction of the strip-shaped sheet which faces a downstream side in a rotation direction of the shaft.

10 Claims, 9 Drawing Sheets

CLEANING ELEMENT FOR AN IMAGE-FORMING APPARATUS, CHARGING DEVICE, PROCESS CARTRIDGE AND IMAGE-FORMING APPARATUS

CROSS-REFERENCE TO RELATED APPLICATION

This application claims priority under 35 USC 119 from Japanese Patent Application No. 2010-146760 filed on Jun. 28, 2010.

BACKGROUND

1. Technical Field

The present invention relates to a cleaning element for an image-forming apparatus, a charging device, a process cartridge and an image-forming apparatus.

2. Related Art

As charging devices for image-forming apparatuses such as copying machines or printers which adopt an electrophotographic system, charging devices having a contact charging system in which an image retainer is charged by directly contacting an electroconductive roll-shaped charging element with the image retainer have been conventionally used.

Since the charging element constantly contacts the image retainer in such charging devices having a contact charging system, the surface of the charging element becomes dirty due to adhesion of toner components, paper powder and the like.

On the other hand, a cleaning system in which surface blots on a charging element are scraped off by contacting a plate-shaped brush or sponge with the surface of the charging element is proposed. Alternatively, a cleaning system in which a roll-shaped cleaning element is brought into contact with the surface of a charging element is also proposed.

Furthermore, charging roller cleaners made from a foamed resin or a foamed rubber have been proposed and used gradually in recent years.

SUMMARY

According to a first aspect of the invention, there is provided a cleaning element for an image-forming apparatus, the cleaning element comprising:

a shaft;

a strip-shaped sheet which is disposed helically on an outer circumferential surface of the shaft; and an adhesive layer which is disposed between the shaft and the strip-shaped sheet and binds the shaft and the strip-shaped sheet, the strip-shaped sheet having, on a surface thereof facing the shaft, an unbound region in which the adhesive layer is absent, at an end in a width direction of the strip-shaped sheet which faces a downstream side in a rotation direction of the shaft.

BRIEF DESCRIPTION OF THE DRAWINGS

Exemplary embodiments of the present invention will be descried in detail based on the following figures, wherein.

DETAILED DESCRIPTION

The cleaning element for an image-forming apparatus, charging device, process cartridge and image-forming apparatus according to the exemplary embodiments of the present invention are explained below in detail.

Cleaning Element

A cleaning element for an image-forming apparatus according to an exemplary embodiment of the invention includes: a shaft; a strip-shaped sheet helically disposed on the outer circumferential surface of the shaft; and an adhesive layer which is disposed between the shaft and the strip-shaped sheet and binds the shaft and the strip-shaped sheet, the adhesive layer being absent in a region, on the surface of the strip-shaped sheet which faces the shaft, at an end in the width direction of the strip-shaped sheet, the end facing the downstream side in the rotation direction of the shaft, whereby an unbound region in which the shaft and the strip-shaped sheet are not bound is formed.

The cleaning element of an exemplary embodiment of the invention is explained with reference to the drawings. The same symbol or numeral is given to elements having similar function and/or effect throughout the drawings, and explanation thereof is omitted in some cases.

Figure 1:
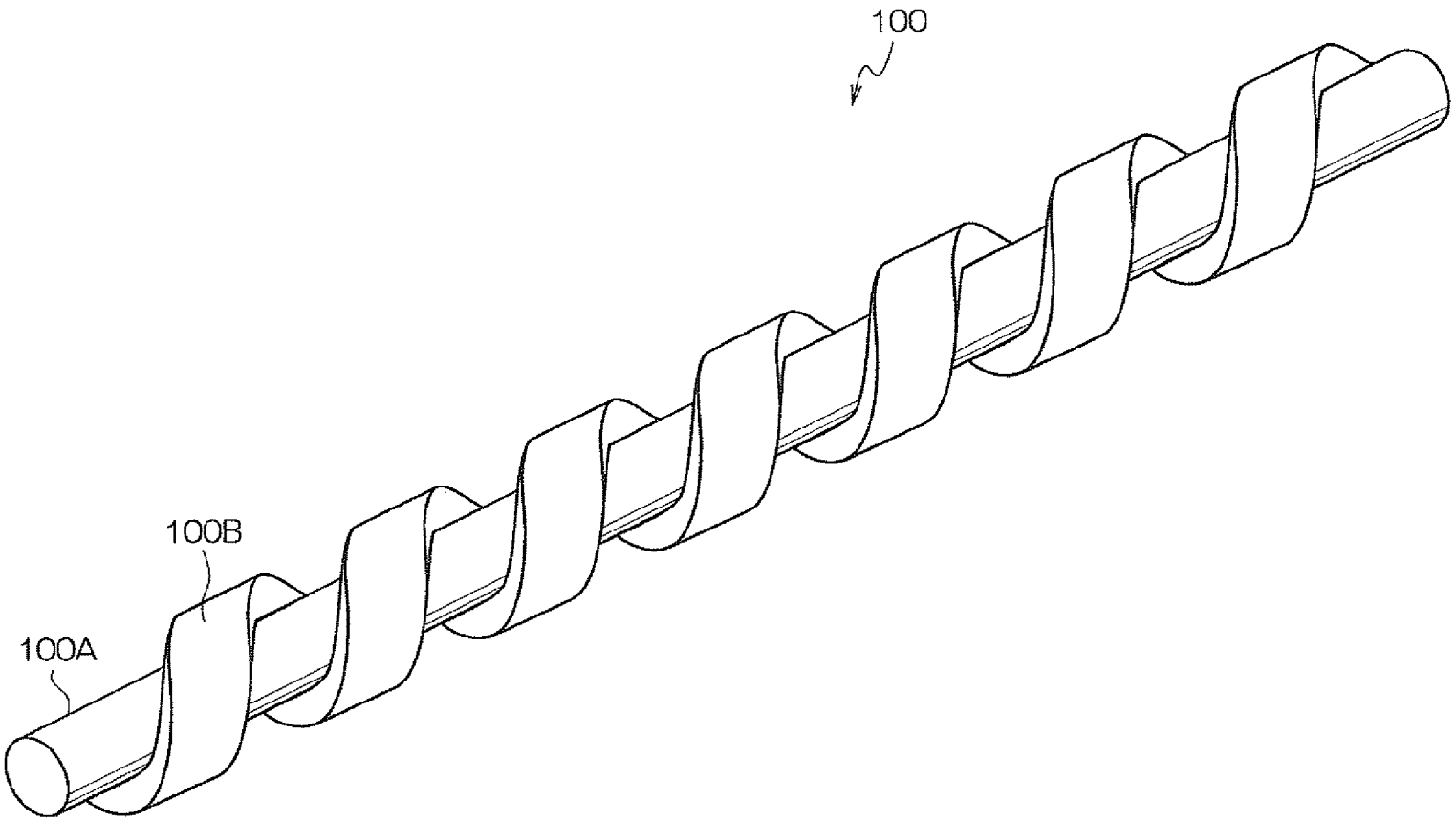
FIG. 1 is a schematic perspective view of a cleaning element for an image-forming apparatus of an exemplary embodiment of the present invention.
Figure 2:
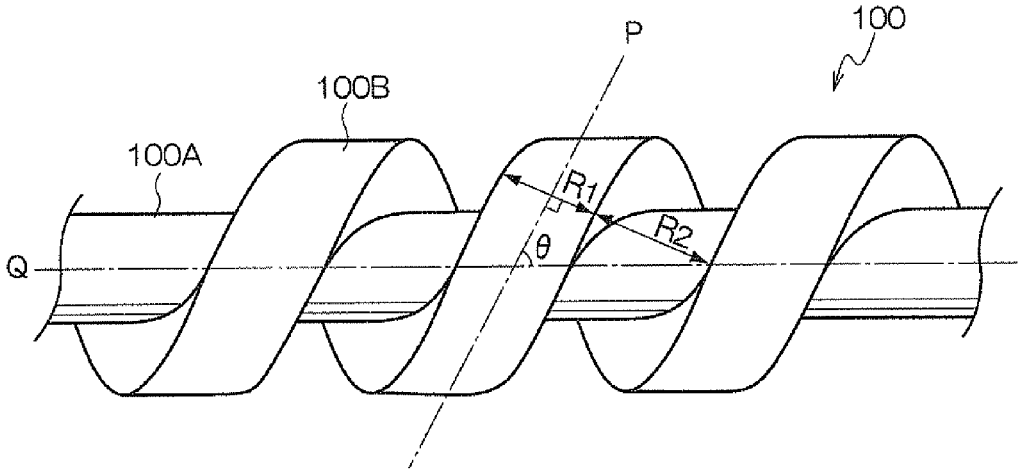
FIG. 2 is an enlarged view of a part of the cleaning element for an image-forming apparatus of the exemplary embodiment of the invention.

FIG. 1 is a schematic perspective view of the cleaning element for an image-forming apparatus of an exemplary embodiment of the invention, and FIG. 2 is a schematic plane view showing a part of the cleaning element shown in FIG. 1.

As shown in FIG. 1, the cleaning element for an image-forming apparatus 100 (hereinafter, simply referred to as "cleaning element") of the exemplary embodiment is a roll-shaped element including a shaft 100A and a strip-shaped sheet (hereinafter, simply referred to as "strip sheet") 100B which is helically disposed on the outer circumferential surface of the shaft 100A. The strip sheet 100B is disposed on the surface of the shaft 100A in a state of being wound helically; that is, the strip sheet 100B is disposed, for example, in a state of being helically wound around the shaft of the shaft 100A, as a helical shaft, with intervals from one end to another end of the shaft 100A.

In the cleaning element 100 shown in FIG. 1, an unbound region in which the strip sheet 100B is not bound to the shaft 100A is formed on the surface of the strip sheet 100B facing the shaft 100A (i.e., the surface of the strip sheet 100B on the side which is wrapped around the shaft 100A in FIG. 1), at an end in the width direction of the strip sheet 100B which faces the downstream side in the rotation direction of the shaft 100A.

The width direction of the strip sheet 100B refers to the direction perpendicular to the longitudinal direction of the strip sheet 100B, namely, the direction of "Width R1" shown in FIG. 2.

Figure 3A:
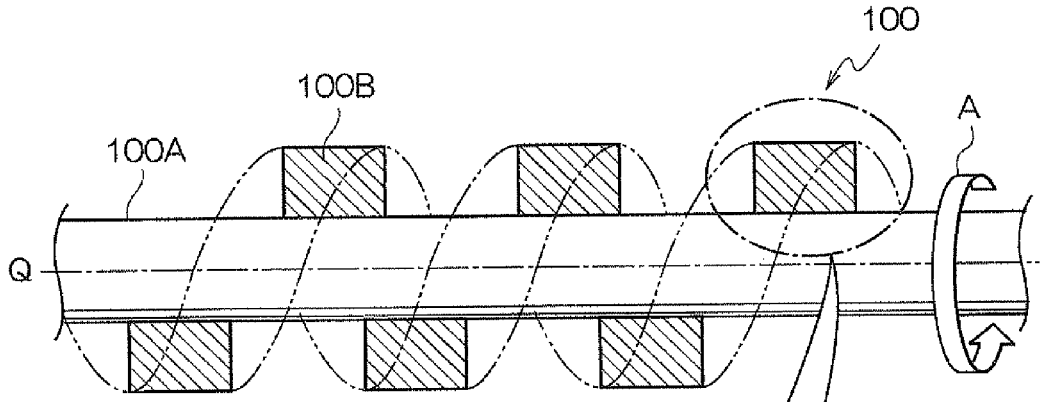
FIG. 3A is a cross-sectional view of a part of a cleaning element for an image-forming apparatus of an exemplary embodiment of the invention.

FIG. 3A is a view illustrating a cross-section of the strip sheet 100B of the cleaning element 100 shown in FIG. 2. In FIG. 3A, the sections other than the cross-section of the strip sheet 100B are represented by two-dot chain lines.

When the cleaning element shown in FIG. 3A cleans the surface of an element to be cleaned by contacting the element to be cleaned, it rotates in the direction of the arrow A (i.e., in the direction toward the front of FIG. 3A). In the cleaning element of the exemplary embodiment, the strip-shaped sheet 100B has, on the surface thereof facing the shaft 100A, an unbound region 100D, in which the strip-shaped sheet 100B is not bound to the shaft 100A, at an end in the width direction of the strip-shaped sheet 100B which faces the downstream side in the rotation direction of the shaft 100A (i.e., the end which is the right end at the surface of the strip sheet 100B facing the shaft 100A, in FIG. 3B which is an enlarged view of a part of FIG. 3A).

The downstream side in the rotation direction refers to the side facing the downstream in the rotation direction of the shaft 100A (for example, the rotation direction refers to the direction of arrow A shown in FIG. 3A). Specifically, the downstream side in the rotation direction refers to, when the shaft 100A rotates in one direction (for example, the direction of arrow A in FIG. 3A), the side closer to the downstream side in the rotation direction of the shaft, than to the upstream side.

In other words, the end, of the strip-shaped sheet, which faces the downstream in the rotation direction refers to the end, in the width direction of the strip-shaped sheet, in the direction in which the helix advances when the cleaning element rotates around the axis of the shaft 100A.

When the shaft 100A rotates, the helix formed by the strip-shaped sheet 100B migrates (advances) to a particular side in the axial direction of the shaft. For example, as shown in FIG. 3A, when the shaft 100A rotates in the direction of arrow A, the helix advances from the left (upstream) to the right (downstream) of the figure.

Accordingly, the end in the direction in which the helix advances refers to the end at the side closer to the downstream of the helix migration, than to the upstream, and, for example, is the right side of FIG. 3A.

The inventors of the present invention have found that, when the shaft 100A rotates while the cleaning element 100 is contacting the surface of the element to be cleaned, an edge of the strip sheet 100B being contacted moves and scrapes off the substances adhered to the surface of the element to be cleaned.

On the other hand, as described above, the cleaning element 100 of the exemplary embodiment has the strip sheet 100B having the unbound region 100D at the end facing the downstream side in the rotation direction; therefore, the strip sheet 100B has a wider movable edge region due to the fact that the edge is not bound to the shaft.

Figure 3B:
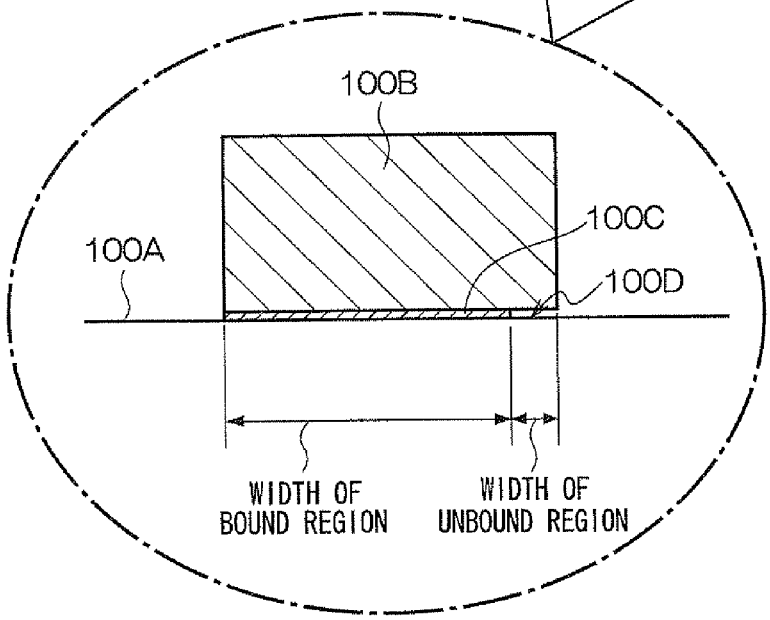
FIG. 3B is an enlarged view of a part of FIG. 3A.

The region, on the surface of the strip sheet 100B facing the shaft 100A as shown in FIG. 3B, other than the unbound region 100D may be a bound area in which the strip sheet 100B and the shaft 100A are attached with the adhesive layer 100C therebetween as shown in FIG. 3B. Alternatively, another unbound region may be formed, on the surface of the strip sheet 100B, at the end opposite to the downstream side in the rotation direction of the shaft (i.e., the upstream side in the rotation direction of the shaft, or the upstream side in the direction of the helix migration; the left end of FIG. 38).

Width of Unbound Region

In view of ensuring the movable area at the edge more effectively, the width of the unbound area 100D arranged at the end, of the strip-shaped sheet, facing the downstream side in the rotation direction of the shaft (i.e., the width of the unbound area shown in FIG. 3B) is preferably about 5% or more (or 5% or more), more preferably about 10% or more (or 10% or more), and particularly preferably about 15% or more (or 15% or more), with respect to the total width (i.e., R1 shown in FIG. 2) of the strip sheet 100B at the surface thereof facing the shaft 100A (i.e., total of the width of the bound region and the width of the unbound region shown in FIG. 3B).

Helix Angle θ

As shown in FIG. 2, an acute angle (hereinafter, referred to as "helix angle θ") formed by the intersection of the line P running along the center of the width direction of the strip sheet 100B and the line Q in the axial direction of the shaft 100A is preferably about 45° or less (or 45° or less), more preferably about 40° or less (or 40° or less), and particularly preferably about 30° or less (30° or less). Since the helix angle θ is 45° or less, when the cleaning element 100 rotates around the shaft 100A while contacting the surface of the element to be cleaned, the end, of the strip-shaped sheet, facing the downstream side in the rotation direction and the surface of the element to be cleaned are contacted in such a manner that the surface of the end facing the downstream side in the rotation direction and the axis of the element to be cleaned are closer to parallel as compared to the case in which the helix angle θ is greater than the upper limit. Accordingly, the end facing the downstream side in the rotation direction and having the unbound region 100D is loaded more effectively and, as a result, the movable region moves more effectively, and the cleaning property is improved.

On the other hand, regarding the lower limit of the helix angle θ, the strip sheet 100B may be wound at an angle at which at least a part of the strip sheet 100B constantly contacts the element to be cleaned when the cleaning element 100 contacts the element to be cleaned and rotates around the shaft 100A to clean the surface of the element to be cleaned. Since at least a part of the strip sheet 100B constantly contacts the element to be cleaned, fine cleaning is carried out.

Specifically, the lower limit of the helix angle θ is preferably 10° or more, and more preferably 20° or more.

In order to exhibit the effect, the edge of the strip sheet 100B of the cleaning element of the exemplary embodiment (the edge at the end of the strip sheet 100B in the width direction thereof at the side facing the downstream of the rotation direction of the shaft 100A) may contact all of the area in the axial direction of the element to be cleaned. From such viewpoint, in an exemplary embodiment, the distance, in the axial direction of the shaft 100A, between two adjacent portions of the helical strip sheet 100B formed on the outer circumference of the shaft 100A (i.e., the interval between two adjacent portions of the helical strip sheet, in the axial direction of the shaft 100A) is larger than the length, in the axial direction of the shaft, of the strip sheet 100B which is helically-disposed on the circumference of the shaft 100A.

In this regard, in an exemplary embodiment, the cleaning element satisfies the following relational formula (1):

$$W \leqq \pi \times r \times \cos\theta \qquad \text{(formula (1))}$$

wherein θ is an acute angle formed by an intersection between a line running along the center of the width direction of the strip-shaped sheet 100B and the axial direction of the shaft; W is the width of the strip-shaped sheet 100B (i.e., the helical width R1 shown in FIG. 2 mentioned below); and r is the radius of the shaft 100A.

Next, the constitutional elements of the cleaning element of an exemplary embodiment are explained.

Shaft

Examples of the material used for the shaft 100A include metals (for example, aluminum, stainless, brass and the like), and resins (for example, polyacetal resin (POM) and the like). It is desirable that the material, surface treatment method and the like are selected as appropriate.

Specifically, when the shaft 100A is formed from a metal, it is desirable to subject the shaft to a plating treatment. Alternatively, when the shaft is formed from a non-conductive material such as a resin, the shaft may be subjected to a treatment for imparting electroconductivity by a general method such as a plating treatment, or may be used as it is.

Strip Sheet

The strip sheet 100B shown in FIG. 1 is disposed helically. In a specific embodiment, the strip sheet may have a helix angle θ shown in FIG. 2 in the range described above, and a helical width R1 of from 3 mm to 25 mm. The helical pitch R2 may be, for example, from 3 mm to 40 mm.

Here, as shown in FIG. 2, the helical width R1 refers to a length along the direction orthogonal to the longitudinal direction P (helical direction) of the strip sheet 100B. The helical pitch R2 refers to a length of an interval between adjacent portions of the strip sheet 100B along the direction orthogonal to the longitudinal direction P (helical direction) of the strip sheet 100B.

On the strip sheet 100B shown in FIG. 1, the region thereof, at the surface facing the shaft, other than the region in which the unbound region is formed is bound by the adhesive layer 100C as shown in FIG. 3B.

Examples of the material for the strip sheet 100B include: formable resins such as polyurethane, polyethylene, polyamide or polypropylene; and rubber materials such as silicone rubber, fluorine rubber, urethane rubber, ethylene-propylene-diene copolymer rubber (EPDM), acrylonitrile-butadiene copolymer rubber (NBR), chloroprene rubber (CR), styrene-butadiene copolymer rubber (SBR), chlorinated polyisoprene rubber, isoprene rubber, acrylonitrile-butadiene rubber, hydrogenated polybutadiene rubber or butyl rubber. Any one of these may be used singly, or a blend of two or more thereof may be used. If necessary, an auxiliary agent such as a foaming aid, a foam adjusting agent, a catalyst, a curing agent, a plasticizer or a vulcanizing agent may be added to the material.

Among these, a material containing air bubbles (so-called foamed product) is preferable, and a foamed polyurethane is particularly preferable.

Examples of polyurethane include reaction products of a polyol (for example, polyester polyol, polyether polyester, acrylic polyol or the like) with an isocyanate (for example, 2,4-tolylenediisocyanate, 2,6-tolylenediisocyanate, 4,4-diphenylmethane diisocyanate, tolidine diisocyanate, 1,6-hexamethylene diisocyanate or the like), and the polyurethane may include a chain extending agent (for example, 1,4-butanediol, trimethylolpropane or the like). A polyurethane is generally foamed by, for example, using water and a foaming agent such as an azo compound (for example, azodicarbonamide, azobisisobutyronitrile or the like). If necessary, an auxiliary agent such as a foaming aid, a foam adjusting agent or a catalyst may be used for the foamed polyurethane.

It is more preferable to use a material which restores its original form even after it is deformed by applying outer force of about 100 Pa for the strip sheet 100B.

The constitution of the strip sheet 100B may be a monolayer structure or a multi-layer structure. Specifically, the strip sheet 100B may have, for example, a constitution composed of one layer of a foamed material, or a constitution including two layers composed of a solid layer and a foamed layer.

The width of the strip sheet 100B, which is also shown as the helical width R1, is preferably from 3 mm to 25 mm, more preferably from 5 mm to 7 mm.

Furthermore, the thickness of the strip sheet 100B (the thickness when the sheet is wound around the shaft 100A) is preferably from 0.5 mm to 5 mm, more preferably from 1.5 mm to 3 mm.

Adhesive Layer

As shown in FIG. 3B, the region of the strip sheet 100B shown in FIG. 1, other than the unbound region, is bound to the shaft by the adhesive layer 100C therebetween. The adhesive layer 100C is a layer which is disposed for binding the base (shaft) 100A and the strip sheet 100B.

An example of a method for conveniently forming the adhesive layer 100C includes a method using an adhesive tape. Examples of the adhesive tape include an adhesive tape having a substrate and an adhesive layer, and an adhesive tape having an adhesive layer with no substrate. Examples of the substrate for the adhesive tape include substrates made from resins such as polyethylene terephthalate (PET) or polyimide (PI), metals, nonwoven fabrics, and paper.

A commercial product may also be used as an adhesive tape used for the adhesive layer 100C, and examples thereof include a double-faced adhesive tape No. 5605 (trade name, manufactured by Nitto Denko Corporation; substrate: a PET resin substrate having a thickness of 0.05 mm), a single-sided adhesive tape No. 360A (trade name, manufactured by Nitto Denko Corporation; substrate: a PI resin substrate having a thickness of 0.025 mm), a single-sided adhesive tape No. 513 (trade name, manufactured by Nitto Denko Corporation; substrate: Japanese paper), and a single-sided adhesive tape 7108AAD (trade name, manufactured by 3M; substrate: nonwoven fabric). Examples of the adhesive tape having no substrate may include a substrate-less double-faced adhesive tape No. 591 (trade name, manufactured by Nitto Denko Corporation).

Production Method

Next, a method of producing the cleaning element 100 according to an exemplary embodiment is explained.

First, a method for forming the unbound area 100D shown in FIG. 3B is explained. Specifically, for example, an adhesive layer 100C is formed in advance, on the surface of the strip sheet 100B at the side facing the shaft 100A, in a region narrower than the width of the strip sheet 100B so that an unbound region 100D is formed on the surface. The strip sheet 100B having the adhesive layer 100C thereon is then wound helically around the shaft 100A.

Next, a method for helically winding the strip sheet 100B on which the adhesive layer 100C has been formed on the shaft 100A so that the unbound area 100D is formed, as mentioned above, is explained.

Figure 4:
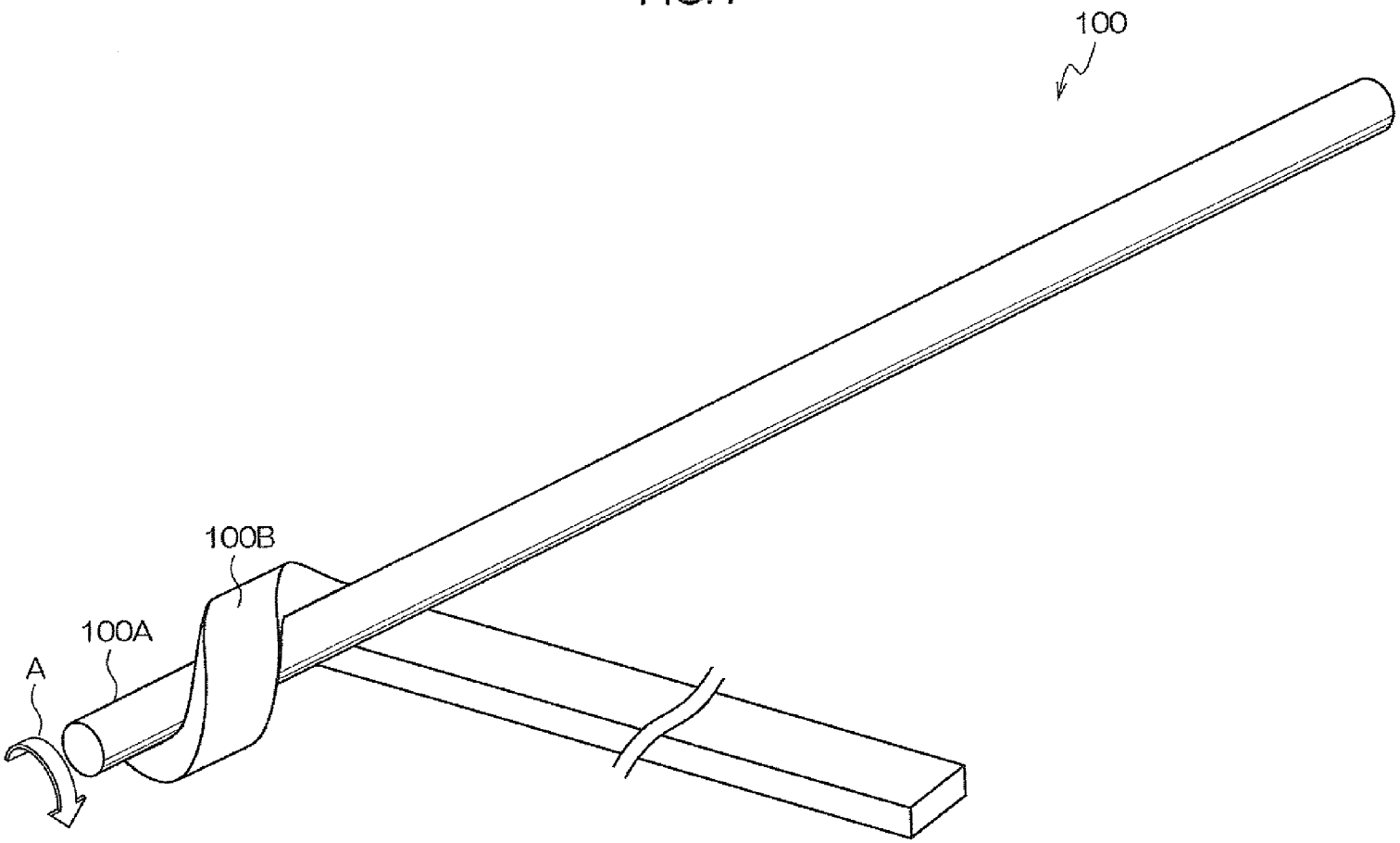
FIG. 4 is a schematic perspective view illustrating a method of preparing a cleaning element for an image-forming apparatus according to an exemplary embodiment of the invention.
Figure 5:
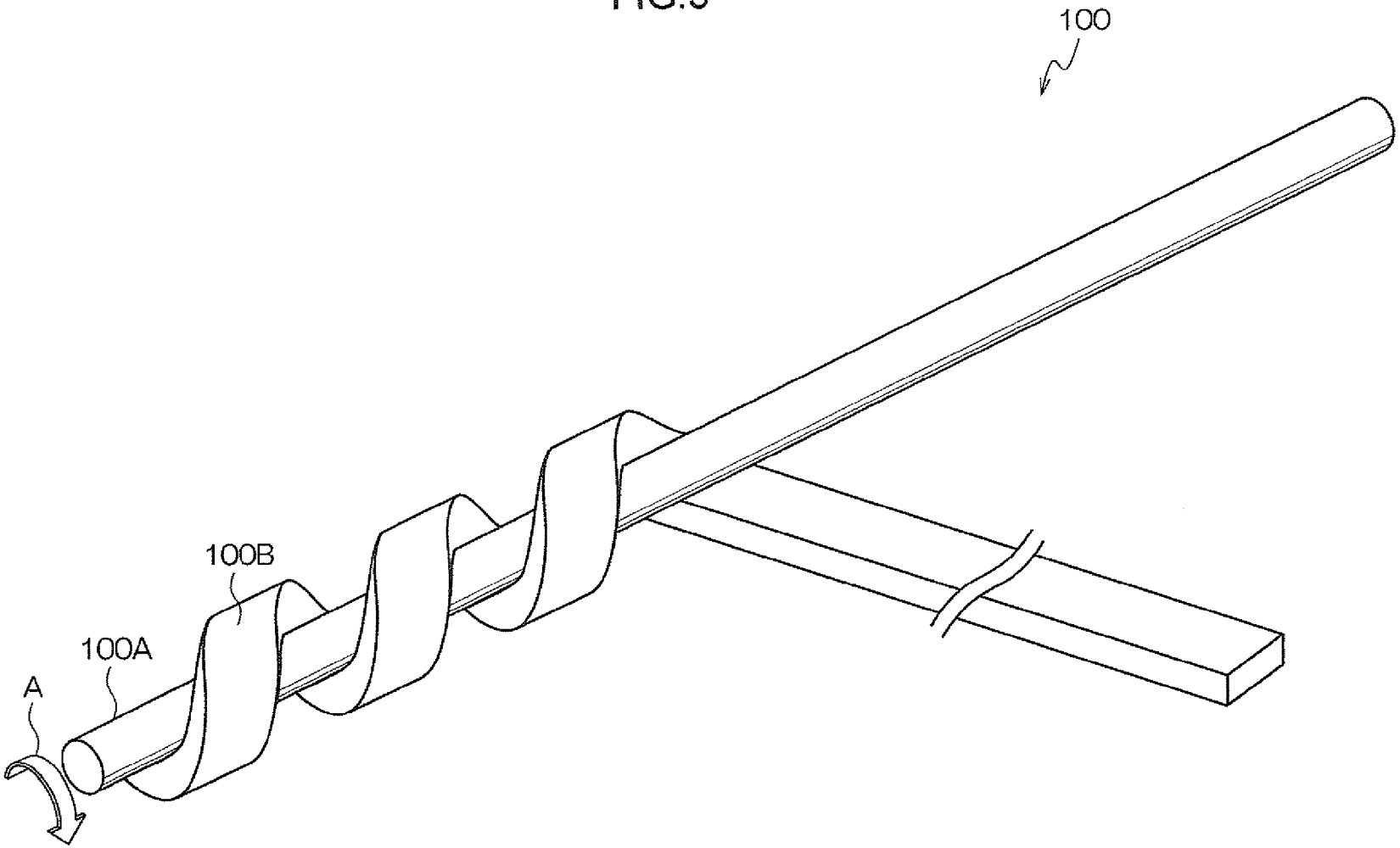
FIG. 5 is a schematic perspective view illustrating a method of preparing a cleaning element for an image-forming apparatus according to an exemplary embodiment of the invention.

As shown in FIG. 4, first, one end in the longitudinal direction of the strip sheet 100B is attached and fixed onto an end in the axial direction of the shaft 100A. Thereafter, the other side of the strip sheet 100B is pulled as shown in FIG. 4 to apply tension thereto to put the sheet in a state of having no slack, and the strip sheet 100B is wound around the outer circumferential surface of the shaft 100A at predetermined intervals as shown in FIG. 5 by rotating the shaft 100A in the direction of arrow A. The winding and attachment of the strip sheet 100B is continued until the helix formed by the strip sheet 100B reaches the other side of the shaft while maintaining the state of having no slack by applying tension. Accordingly, the cleaning element 100 shown in FIG. 1 in which the strip sheet 100B is helically wound around the outer circumferential surface of the shaft 100A is produced.

In an exemplary embodiment, when the strip sheet 100B is helically wound on the shaft 100A, the winding angle against the shaft direction (namely, the helix angle θ shown in FIG. 2) may be changed part way through, so that the distances (namely, the helical pitch R2 shown in FIG. 2) between adjacent portions of the strip sheet 100B helically wound on the outer circumferential surface of the shaft 100A may vary from one another. In this case, an embodiment in which the distances between adjacent portions vary from one another means that a ratio of the length of the maximum interval to the length of the minimum interval is 101% or more.

An example of the exemplary embodiment in which the helix angle θ is changed in the shaft direction includes, for example, an embodiment in which the helix angles θ at the ends in the axial direction of the shaft are made relatively small, and the helix angles θ at the central region in the axial direction of the shaft are made relatively large. In a cleaning element in which the helix angles θ at the ends in the axial direction of the shaft are relatively small and helix angles θ at the central region are relatively large, the contact surface area thereof with an element to be cleaned at the central region in the axial direction of the shaft is larger than those at the ends.

In an embodiment of an image-forming apparatus in which a roll-shaped charging element contacts an image retainer and a roll-shaped cleaning element contacts the charging element, a gap between the central portion of the charging element and the image retainer is easily achieved by flexing of the shaft, when the charging element is arranged against the image retainer with a constant load at the both ends of the charging element. In this regard, when the cleaning element, in which the helix angles θ at the ends in the axial direction of the shaft are relatively small and helix angles θ at the central portion in the axial direction of the shaft are relatively large, is used, the force that pushes the charging element becomes relatively larger at the central portion, whereby generation of a gap between the charging element and the image retainer is suppressed, and the unevenness of charging of the image retainer is consequently suppressed.

In exemplary embodiments, the cleaning element 100 is not limited to that produced by the production method described above.

For example, the cleaning element 100 may be produced by, first, a material for forming the strip sheet 100B (for example, a foamed material such as a foamed polyurethane) being formed into a desired shape, and an insertion pore being perforated at the center in the axial direction thereof. Then, the shaft 100A on which an adhesive layer has been formed is inserted through the insertion pore and fixed, and the outer circumference of the material for forming the strip sheet 100B is ground into a cylindrical form using a cylindrical grinding machine or the like. Subsequently, a helical groove which reaches the shaft 100A is formed on the material for forming the strip sheet 100B, to form the strip sheet 100B, and a part of the adhesive layer at the end facing the downstream side in the rotation direction of the shaft 100A, in the width direction of the strip sheet 100B, is removed, whereby the cleaning element 100 may be produced.

Image Forming Apparatus and the Like

An image-forming apparatus of an exemplary embodiment of the invention is explained below with referring to the drawings.

Figure 6:
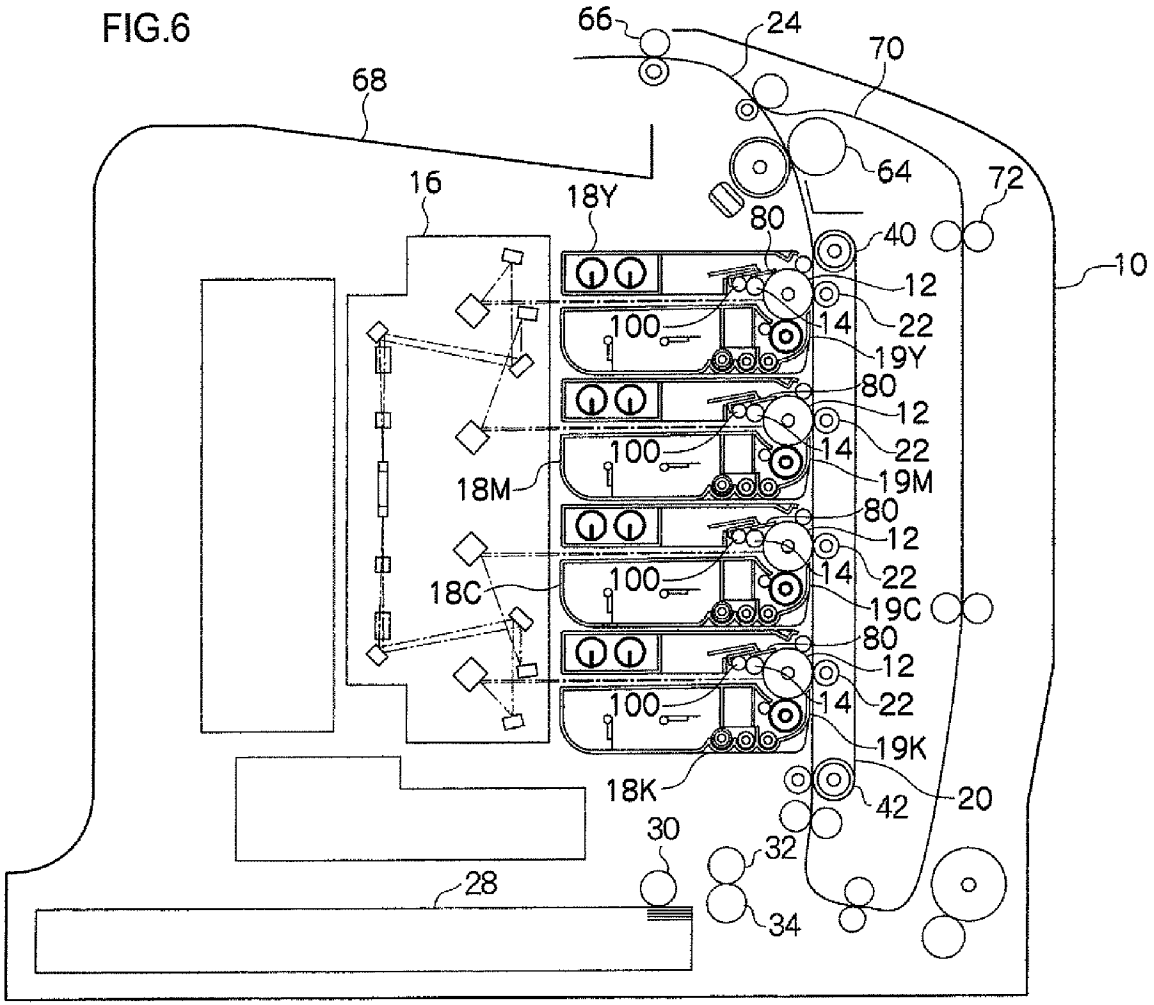
FIG. 6 is a schematic constitutional view showing an electrophotographic image-forming apparatus of an exemplary embodiment of the invention.

FIG. 6 is a schematic constitutional drawing which shows the image-forming apparatus of the exemplary embodiment.

Figure 7:
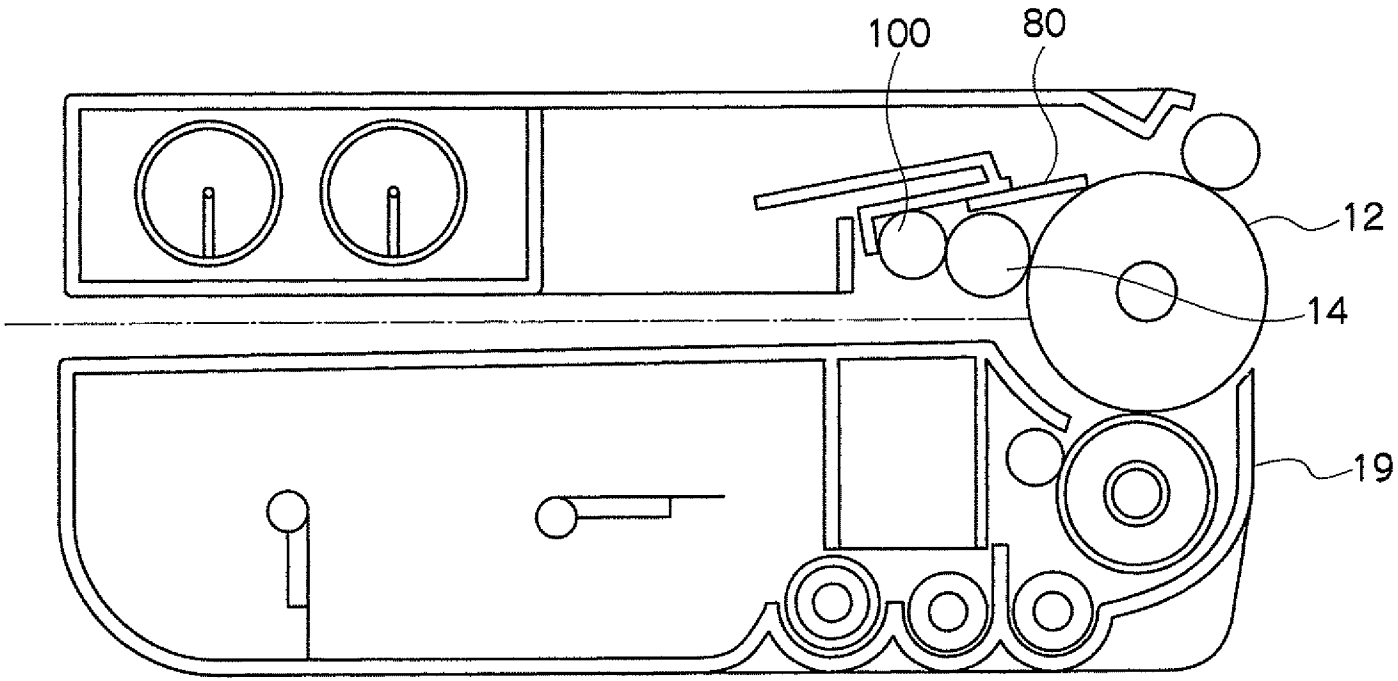
FIG. 7 is a schematic constitutional view showing a process cartridge of an exemplary embodiment of the invention.

The image-forming apparatus 10 of the exemplary embodiment is, for example, a tandem-type color image-forming apparatus as shown in FIG. 6. The image-forming apparatus 10 of the exemplary embodiment houses photoreceptors (image retainers) 12, charging elements 14, a developing device and the like, in process cartridges for respective colors of yellow (18Y), magenta (18M), cyan (18C) and black (18K) (see FIG. 7). The process cartridges have constitutions which are detached from and attached to the image-forming apparatus 10.

As the photoreceptor 12, for example, an electroconductive cylindrical body having a diameter of 25 mm and having a surface coated with a photoreceptor layer formed from an organic photosensitive material or the like is used, and is rotationally-driven by a motor (not shown) at a processing speed of, for example, 150 mm/sec.

The surface of the photoreceptor 12 is charged by the charging element 14 disposed on the surface of the photoreceptor 12, and thereafter an image is exposed by laser beam radiated from exposing device 16 from the charging element 14 to the downstream side of the rotation direction of the photoreceptor 12, whereby an electrostatic latent image according to image information is formed.

The electrostatic latent image formed on the photoreceptors 12 is developed by developing devices 19Y, 19M, 19C and 19K for respective colors of yellow (Y), magenta (M), cyan (C) and black (K), whereby toner images having respective colors are formed.

For example, when a color image is to be formed, the respective steps of charging, exposing and developing are carried out on the surfaces of the photoreceptors 12 of respective colors of yellow (Y), magenta (M), cyan (C) and black (K), and toner images corresponding to respective colors of yellow (Y), magenta (M), cyan (C) and black (K) are formed on the surfaces of the photoreceptors 12 of respective colors.

A recording paper sheet 24 housed in the recording paper housing section 28 is pickup by the pickup roll 30 and inserted between the pair of paper carrying rolls 32 and 34, and the recording paper sheet 24 is further conveyed onto the paper carrying belt 20 by the pair of paper carrying rolls 32 and 34. The paper carrying belt 20 is supported and tensioned by supporting rolls 40 and 42.

The toner images of respective colors of yellow (Y), magenta (M), cyan (C) and black (K), which are sequentially formed on the photoreceptor 12, are transferred onto the recording paper 24, which is carried between the paper carrying belt 20 and the outer circumferences of the photoreceptors 12, at the region in which the photoreceptors 12 are brought in contact with the transfer device 22 via the paper carrying belt 20. Furthermore, the recording paper 24 on which the toner images have been transferred from the photoreceptors 12 is carried to the fixing device 64, and heated and pressurized by the fixing device 64, whereby the toner images are fixed on the recording paper sheet 24. Then, in a case of single-sided printing, the recording paper sheet 24 on which the toner images have been fixed is directly ejected by the ejection roll 66 onto the ejection unit 68 arranged in the upper section of the image-forming apparatus 10.

On the other hand, in the case of double-faced printing, the recording paper sheet 24 having a first surface (front surface) on which the toner images have been fixed by the fixing device 64, is not directly ejected onto the ejection unit 68 by the ejection roll 66, but the ejection roll 66 is traversely rotated while the rear end of the recording paper sheet 24 is pinched by the ejection roll 66; the path for carrying the recording paper 24 is switched to paper carrying path 70 for double-facing; the face and rear surfaces of the recording paper 24 are reversed by carrying roll 72 disposed on the paper carrying path 70 for double-facing, and the recording paper is carried to the paper carrying belt 20 again; and the toner images are transferred on the second surface (rear surface) of the recording paper 24 from the photoreceptors 12. The toner images on the second surface (rear surface) of the recording paper 24 are then fixed by the fixing device 64, and the recording medium 24 (object) is ejected on the ejection unit 68.

After the transfer of the toner image is completed, the blade 80 which is disposed, on the surface of the photoreceptor 12, at the downstream side in the rotation direction of the photoreceptor 12 with respect to the position at which the transfer device 22 contacts the surface of the photoreceptor 12, removes residual toner and paper powder per every rotation of the photoreceptor 12, which enables the next image-forming step.

Figure 8:
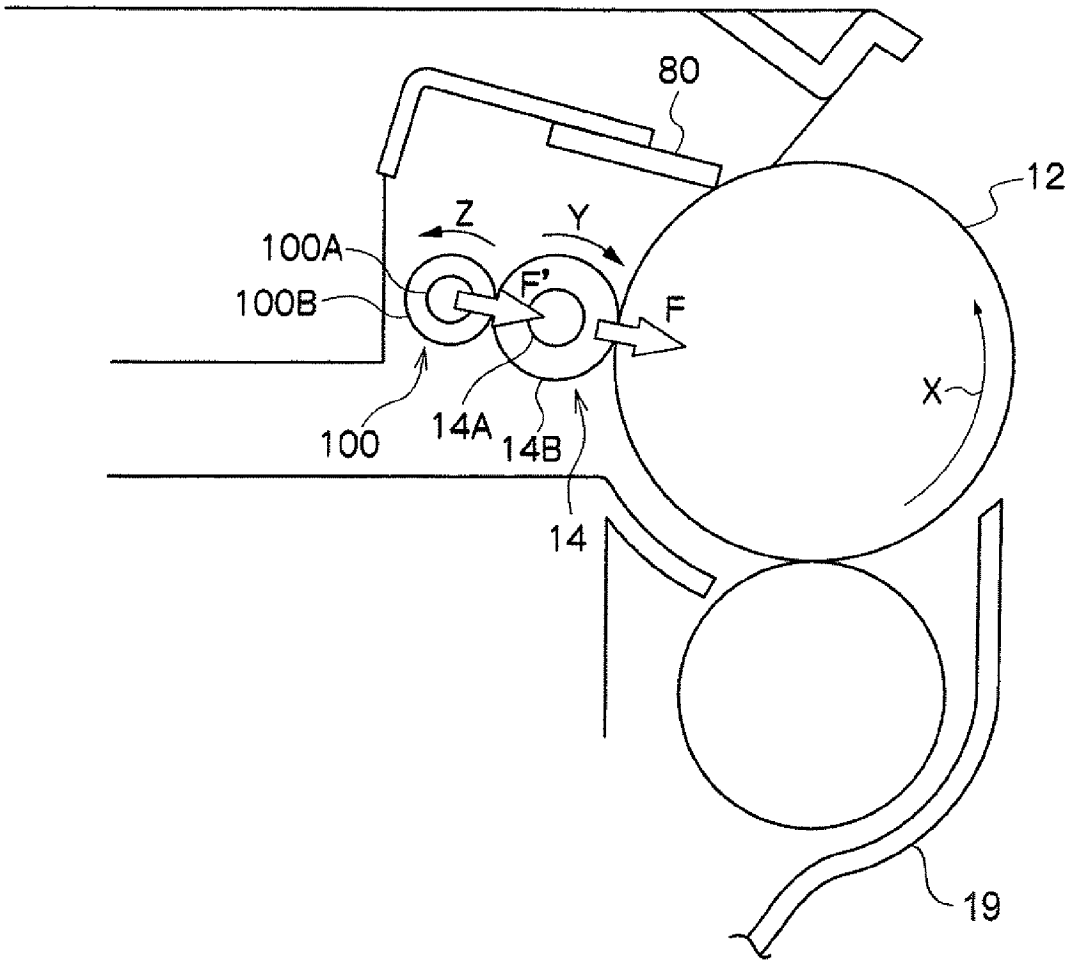
FIG. 8 is a schematic constitutional view showing an enlarged view of the circumference part of the charging element (charging device) shown in FIGS. 6 and 7.
Figure 9:
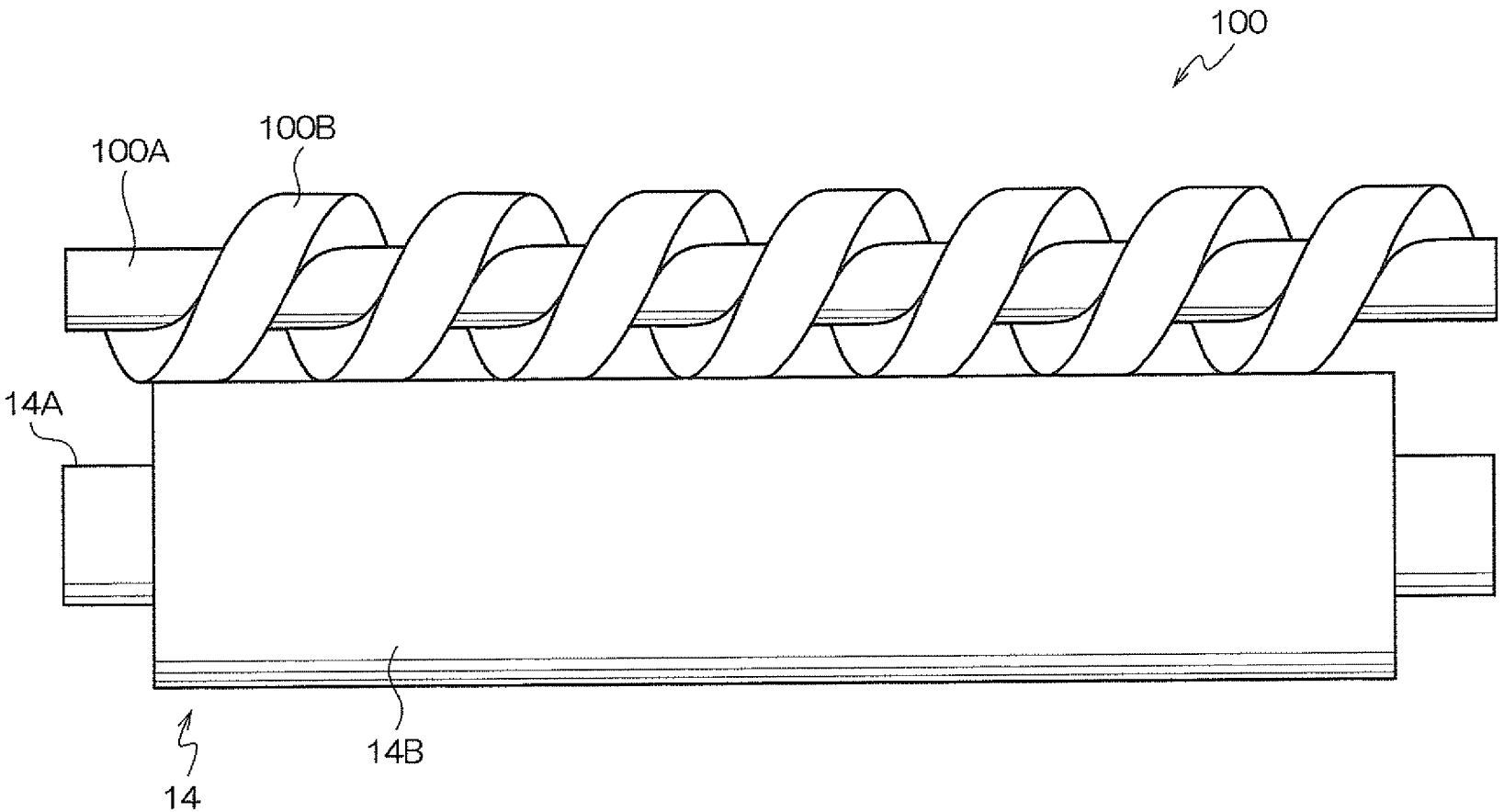
FIG. 9 is a schematic constitutional view showing a charging device of an exemplary embodiment of the invention.

Here, as shown in FIGS. 8 and 9, the charging element 14 is, for example, a roll obtained by forming an elastic layer 14B around an electroconductive shaft 14A, and the electroconductive shaft 14A is rotatably supported. The cleaning element 100 is in contact with the charging element 14 at the side opposite to the photoreceptor 12, thereby forming a charging device (charging unit). As the cleaning element 100, the cleaning element 100 of the exemplary embodiment of the invention is used.

The charging element 14 is pressed onto the photoreceptor 12 by applying load F onto the both ends of the electroconductive shaft 14A, and is elastically deformed along the circumference surface of the elastic layer 14B to form a nip section. Furthermore, the cleaning element 100 is pressed onto the charging element 14 by applying load F onto the both ends of the electroconductive shaft 100A, and the elastic layer 100B is elastically deformed along the circumference surface of the charging element 14 to form a nip section. As result, the slack of the charging element 14 is suppressed, and a nip section in the axial direction of the photoreceptor 12 with the charging element 14.

The photoreceptor 12 is rotationally driven by a motor (not shown) in the direction of arrow X, and the charging element 14 rotates depending on the rotation of the photoreceptor 12 in the direction of arrow Y. Furthermore, the cleaning element 100 rotates depending on the rotation of the charging element 14 in the direction of arrow Z.

Configuration of Charging Element

The configuration of the charging element is explained below, but is not limited to the following configuration in the present invention. The symbols are omitted in the explanation.

The configuration of the charging element is not specifically limited. For example, a charging element may have an electroconductive shaft and an elastic layer or a resin layer instead of the elastic layer. The elastic layer may be a single layer, or may have a multi-layer constitution including plural different layers having various functions. Furthermore, the elastic layer may be subjected to a surface treatment.

Examples of usable materials for the electroconductive shaft include free-cutting steel and stainless steel. The material and surface treatment method may be selected depending on the application such as slidability. The shaft may be subjected to a plating treatment. When a material having no electroconductivity is used, the material may be subjected to a treatment for imparting electroconductivity by processing by a general treatment such as a plating treatment.

The elastic layer is an electroconductive elastic layer. The electroconductive elastic layer may include an elastic material having elasticity such as a rubber, an electroconductive agent which adjusts the resistance of the electroconductive elastic layer such as carbon black or an ion electroconductive agent, and, if necessary, any of materials which may be generally added to an electroconductive elastic layer, such as a softening agent, a plasticizer, a curing agent, a vulcanizing agent, a vulcanization accelerating agent, an anti-aging agent, or a filler such as silica or calcium carbonate. The elastic layer may be formed by applying a mixture of the materials which are generally added to a rubber on the circumference surface of an electroconductive shaft. As the electroconductive agent aiming at adjusting a resistance value, a dispersion of a material which electrically conducts at least one of electron and ion as a charge carrier such as carbon black or an ion electroconductive agent which is incorporated in a matrix material, or the like is used. Furthermore, the elastic material may be a foamed product.

The elastic material usable for forming the electroconductive elastic layer is formed, for example, by dispersing an electroconductive agent in a rubber material. Preferable examples of the rubber material include silicone rubbers, ethylene propylene rubbers, epichlorohydrin-ethylene oxide copolymer rubbers, epichlorohydrin-ethylene oxide-allyl glycidyl ether copolymer rubbers, acrylonitrile-butadiene copolymer rubbers, and blend rubbers thereof. These rubber materials may be foamed or unfoamed.

As the electroconductive agent, an electron electroconductive agent or an ion electroconductive agent may be used. Examples of the electron electroconductive agent include micropowders of: carbon blacks such as ketjen black or acetylene black; heat decomposed carbon or graphite; various electroconductive metals such as aluminum, copper, nickel or stainless steel or alloys thereof; various electroconductive metal oxides such as tin oxide, indium oxide, titanium oxide, tin oxide-antimony oxide solid solution or tin oxide-indium oxide solid solution; insulating materials having a surface subjected to a treatment for imparting electroconductivity; and the like. Examples of the ion electroconductive agent include perchlorates, chlorates and the like of tetraethyl ammonium, lauryl trimethyl ammonium and the like; and perchlorates, chlorates and the like of alkali metals and alkaline earths such as lithium or magnesium.

These electroconductive agents may be used singly, or in combination of two or more thereof. Furthermore, although the addition amount thereof is not specifically limited, it is preferably in the range of from 1 part by weight to 60 parts by weight with respect to 100 parts by weight of the rubber material, whereas the amount of an electroconductive agent to be added is preferably in the range of from 0.1 part by weight to 5.0 parts by weight with respect to 100 parts by weight of the rubber material.

A surface layer may be formed on the surface of the charging element. The material for the surface layer is not specifically limited, and any of resins, rubbers and the like may be used. Preferable examples thereof include polyvinylidene fluoride, ethylene tetrafluoride copolymer, polyester, polyimide and copolymerized nylon.

Examples of the copolymerized nylon include those including, as polymerization units, one or plural kinds of nylon-610, nylon-11 and nylon-12, and may further include, as another polymerization unit, nylon-6, nylon-66 or the like. The proportion of the polymerization units of nylon-610, nylon-11 or nylon-12 included in the copolymer is desirably 10% or more by the weight ratio in total.

The high molecular weight materials usable for the surface layer may be used singly, or as a mixture of two or more kinds thereof. Furthermore, the number average molecular weight of the high molecular weight material is preferably in the range of from 1,000 to 100,000, and more preferably in the range of from 10,000 to 50,000.

An electroconductive material may be added to the surface layer to adjust the resistance value. The electroconductive material preferably has a particle size of 3 μm or less.

Alternatively, as the electroconductive agent for adjusting the resistance value, an electroconductive agent in which a material which electrically conducts at least one of electron and ion as a charge carrier such as carbon black, electroconductive metal oxide particles or ion electroconductive agents which are incorporated in a matrix material may be used.

Specific examples of carbon black for the electroconductive agent include "SPECIAL BLACK 350", "SPECIAL BLACK 100", "SPECIAL BLACK 250", "SPECIAL BLACK 5", "SPECIAL BLACK 4", "SPECIAL BLACK 4A", "SPECIAL BLACK 550", "SPECIAL BLACK 6", "COLOR BLACK FW200", "COLOR BLACK FW2" and "COLOR BLACK FW2V" (all trade names, manufactured by Degussa); and "MONARCH1000", "MONARCH1300", "MONARCH1400", "MOGUL-L" and "REGAL400R" (all trade names, manufactured by Cabot).

It is preferable that the carbon black has a pH of 4.0 or less.

The electroconductive metal oxide particles, which are electroconductive particles for adjusting the resistance value are not specifically limited, and any electroconductive agent which is in the form of particles having electroconductivity and using electron as an electrical charge carrier such as tin oxide, tin oxide doped with antimony, zinc oxide, anatase type titanium oxide or tin indium oxide (ITO) may be used. These may be used singly, or in combination of two or more kinds thereof. The particle size thereof is not limited. Tin oxide, tin oxide doped with antimony and anatase titanium oxide are preferable, and tin oxide and tin oxide doped with antimony are more preferable.

Furthermore, a fluorine-containing or silicone-containing resin is preferably used for the surface layer. Specifically, the surface layer is preferably formed from a fluorine-modified acrylate polymer. Alternatively, particles may be added to the surface layer. Alternatively, insulating particles such as alumina or silica may be added to impart concavities on the surface of the charging element.

The outer diameter of the charging element is preferably from 6 mm to 16 mm. The outer diameter is measured by using a commercially available slide gauge or a laser system apparatus for measuring outer diameters.

The microhardness of the charging element is preferably from 45° to 70°. In order to decrease the hardness, use of a method for increasing the addition amount of a plasticizer and use of a material having low hardness such as a silicone rubber may be considered.

As the microhardness of the charging element, a value measured by using a hardness meter (trade name: TYPE MD-1, manufactured by Kobunshi Keiki Co., Ltd.) is used.

Although a process cartridge including a photoreceptor (image retainer), a charging device (unit including a charging element and a cleaning element), a developing device and a cleaning blade (cleaning device) is explained in the image-forming apparatus of the exemplary embodiment, the process cartridge is not limited to this exemplary embodiment, and a process cartridge including a charging device (unit including a charging element and a cleaning element) and those selected from a photoreceptor (image retainer), an exposing device, a transfer device and a developing device and a cleaning blade (cleaning device) as necessary may also be used. Alternatively, an embodiment in which these devices and elements are not incorporated in cartridges but are directly disposed on the image-forming apparatus may also be used.

Furthermore, in the image-forming apparatus of the exemplary embodiment, an embodiment in which the charging device is formed of the unit including the charging element and the cleaning element is explained, i.e., an embodiment in which the charging element is adopted as an element to be cleaned, is explained, the embodiment is not limited thereto, and examples of the element to be cleaned may include a photoreceptor (image retainer), a transfer device (transfer element; transfer roll), and an intermediate object (intermediate transfer belt). Furthermore, the unit of the element to be cleaned and the cleaning element disposed in contact with the element may be directly disposed on the image-forming apparatus, or may be incorporated into a cartridge as in the process cartridge and disposed on the image-forming apparatus.

Moreover, the image-forming apparatus of the invention is not limited to the configurations, and a well-known image-forming apparatus such as an image-forming apparatus of an intermediate transfer system may be adopted.

EXAMPLES

The cleaning element of exemplary embodiments is explained below in more detail with referring to Examples.

Production of Charging Roll

First, 3 parts by weight of an ion electroconductive agent (trade name: PEL-100, manufactured by Japan Carlit Co., Ltd.) is added to 100 parts by weight of an epichlorohydrin rubber. The mixture is sufficiently kneaded, and subjected to extrusion molding. A SUM-Ni shaft having ϕ of 6 mm (lead-free free-cutting steel (trade name: SUM-24EZ, manufactured by Nippon Steel Corporation.) whose surface has been subjected to electroless nickel plating) is inserted to the molded product, and the resultant produce is subjected to molding using a press molding machine and vulcanization, and processed by polishing so as to have a desired outer diameter, and processed so as to have an end outer diameter ϕ of 8.95 mm, and a center outer diameter ϕ of 9.00 mm. Thereafter the surface of the charging roll is coated with a fluorine-containing resin by a dip coating method, thereby forming a film having a thickness of 5 μm.

Example 1

Preparation of Cleaning Element for Charging Roll

A urethane material (trade name: EP70, manufactured by INOAC CORPORATION) obtained by mixing a polyether and an isocyanate and curing the obtained urethane resin by heating to form a three-dimensional network structure is formed into a sheet having a thickness of 2.35 mm, and cut into strips each having a width of 5.5 mm and a length of 256 mm (the length is the minimum length). A double-faced adhesive tape (trade name: No. 5605, manufactured by Nitto Denko Corporation) having a substrate formed from a polyethylene terephthalate (PET) resin having a thickness of 0.05 mm and a width of 5.0 mm is attached to the central region in the width direction of the strip sheet, thereby forming a strip-shape sheet (A1) having an adhesive tape. The strip-shaped sheet (A1) has a region (i.e., unbound region), in which no double-faced adhesive tape is provided, at one end in the width direction thereof, and the width of the unbound region in the width direction of the strip-shaped sheet (A1) is 0.25 mm, and the width of the unbound region is 4.5% with respect to the total width of the strip sheet.

One end in the longitudinal direction of the strip-shaped sheet (A1) is attached to a predetermined position of a shaft which has a diameter of 4 mm and is formed from free-cutting steel having electroless nickel plating thereon. The strip-shape sheet (A1) is then wound helically around the shaft so that the angle against the axial direction of the shaft (i.e., the helix angle θ shown in FIG. 2) becomes 26°, by rotating the shaft while the strip-shaped sheet (A1) is pulled with tension in the longitudinal direction thereof so as to prevent slack, thereby producing a cleaning element for a charging roll.

The numerical value of "π×r×cos θ" in the relational formula (1) is 5.64, and the width (W) of the strip-shape sheet (A1) is 5.5 mm as mentioned above.

Example 2

Preparation of Cleaning Element for Charging Roll

A urethane material (trade name: EP70, manufactured by INOAC CORPORATION) obtained by mixing a polyether and an isocyanate and curing the obtained urethane resin by heating to form a three-dimensional network structure is formed into a sheet having a thickness of 2.35 mm, and cut into strips each having a width of 5.5 mm and a length of 256 mm (the length is the minimum length). A double-faced adhesive tape (trade name: No. 5605, manufactured by Nitto Denko Corporation) having a substrate composed of a polyethylene terephthalate (PET) resin having a thickness of 0.05 mm and a width of 3.5 mm is attached to the central region in the width direction of the strip sheet, thereby forming a strip-shapes sheet (A2) having an adhesive tape. The strip-shaped sheet (A2) has a region (i.e., unbound region), in which no double-faced adhesive tape is provided, at one end in the width direction thereof, and the width of the unbound region in the width direction of the strip-shaped sheet (A2) is 1.0 mm, and the width of the unbound region is 18% with respect to the total width of the strip sheet.

One end in the longitudinal direction of the strip-shape sheet (A2) is attached to a predetermined position of a shaft which has a diameter of 4 mm and is formed from free-cutting steel having electroless nickel plating thereon. The strip-shape sheet (A2) is then wound helically around the shaft so that the angle against the axial direction of the shaft (i.e., the helix angle θ shown in FIG. 2) becomes 26°, by rotating the shaft while the strip-shape sheet (A2) is pulled with tension in the longitudinal direction thereof so as to prevent slack, thereby producing a cleaning element for a charging roll.

The numerical value of "π×r×cos θ" in the relational formula (1) is 5.64, and the width (W) of the strip-shape sheet (A2) is 5.5 mm as mentioned above.

Example 3

Preparation of Cleaning Element for Charging Roll

A urethane material (trade name: EP70, manufactured by INOAC CORPORATION) obtained by mixing a polyether and an isocyanate and curing the obtained urethane resin by heating to form a three-dimensional network structure is formed into a sheet having a thickness of 2.35 mm, and cut into strips each having a width of 5.5 mm and a length of 256 mm (the length is the minimum length). A double-faced adhesive tape (trade name: No. 5605, manufactured by Nitta Denko Corporation) having a substrate formed from a polyethylene terephthalate (PET) resin having a thickness of 0.05 mm and a width of 4.4 mm is attached to the central region in the width direction of the strip sheet, thereby forming a strip-shape sheet (A3) having an adhesive tape. The strip-shaped sheet (A3) has a region (i.e., unbound region), in which no double-faced adhesive tape is provided, at one end in the width direction thereof, and the width of the unbound region in the width direction of the strip-shaped sheet (A3) is 0.55 mm, and the width of the unbound region is 10% with respect to the total width of the strip sheet.

One end in the longitudinal direction of the strip-shape sheet (A3) is attached to a predetermined position of a shaft which has a diameter of 4 mm and is formed from free-cutting steel having electroless nickel plating thereon. The strip-shape sheet (A3) is then wound helically around the shaft so that the angle against the axial direction of the shaft (i.e., the helix angle θ shown in FIG. 2) becomes 26°, by rotating the shaft while the strip-shaped sheet (A3) is pulled with tension in the longitudinal direction thereof so as to prevent slack, thereby producing a cleaning element for a charging roll.

The numerical value of "π×r×cos θ" in the relational formula (1) is 5.64, and the width (W) of the strip-shape sheet (A3) is 5.5 mm as mentioned above.

Example 4

Preparation of Cleaning Element for Charging Roll

A urethane material (trade name: EP70, manufactured by INOAC CORPORATION) obtained by mixing a polyether and an isocyanate and curing the obtained urethane resin by heating to form a three-dimensional network structure is formed into a sheet having a thickness of 2.35 mm, and cut into strips each having a width of 5.5 mm and a length of 325 mm (the length is the minimum length). A double-faced adhesive tape (trade name: No. 5605, manufactured by Nitto Denko Corporation) having a substrate formed from a polyethylene terephthalate (PET) resin having a thickness of 0.05 mm and a width of 4.4 mm is attached to the central region in the width direction of the strip sheet, thereby forming a strip-shape sheet (A4) having an adhesive tape. The strip-shaped sheet (A4) has a region (i.e., unbound region), in which no double-faced adhesive tape is provided, at one end in the width direction thereof, and the width of the unbound region in the width direction of the strip-shaped sheet (A4) is 0.55 mm, and the width of the unbound region is 10% with respect to the whole width of the strip sheet.

One end in the longitudinal direction of the strip-shaped sheet (A4) is attached to a predetermined position of a shaft which has a diameter of 4 mm and is formed from free-cutting steel having electroless nickel plating thereon. The strip-shape sheet (A4) is then wound helically around the shaft so that the angle against the axial direction of the shaft (i.e., the helix angle θ shown in FIG. 2) becomes 45°, by rotating the shaft while the strip-shape sheet (A4) is pulled with tension in the longitudinal direction thereof so as to prevent slack, thereby producing a cleaning element for a charging roll.

The numerical value of "π×r×cos θ" in the relational formula (1) is 4.44, and the width (W) of the strip-shape sheet (A4) is 5.5 mm as mentioned above.

Example 5

Preparation of Cleaning Element for Charging Roll

A urethane material (trade name: EP70, manufactured by INOAC CORPORATION) obtained by mixing a polyether and an isocyanate and curing the obtained urethane resin by heating to form a three-dimensional network structure is formed into a sheet having a thickness of 2.35 mm, and cut into strips each having a width of 4.4 mm and a length of 325 mm (the length is the minimum length). A double-faced adhesive tape (trade name: No. 5605, manufactured by Nitto Denko Corporation) having a substrate formed from a polyethylene terephthalate (PET) resin having a thickness of 0.05 mm and a width of 3.52 mm is attached to the central region in the width direction of the strip sheet, thereby forming a strip-shaped sheet (A5) having an adhesive tape. The strip-shaped sheet (A5) has a region (i.e., unbound region), in which no double-faced adhesive tape is provided, at one end in the width direction thereof, and the width of the unbound region in the width direction of the strip-shaped sheet (A5) is 0.44 mm, and the width of the unbound region is 10% with respect to the total width of the strip sheet.

One end in the longitudinal direction of the strip-shaped sheet (A5) is attached to a predetermined position of a shaft which has a diameter of 4 mm and is formed from free-cutting steel having electroless nickel plating thereon. The strip-shape sheet (A5) is then wound helically around the shaft so that the angle against the axial direction of the shaft (i.e., the helix angle θ shown in FIG. 2) becomes 45°, by rotating the shaft while the strip-shaped sheet (A5) is pulled with tension in the longitudinal direction thereof so as to prevent slack, thereby producing a cleaning element for a charging roll.

The numerical value of "π×r×cos θ" in the relational formula (1) is 4.44, and the width (W) of the strip-shape sheet (A5) is 4.4 mm as mentioned above.

Example 6

Preparation of Cleaning Element for Charging Roll

A urethane material (trade name: EP70, manufactured by INOAC CORPORATION) obtained by mixing a polyether and an isocyanate and curing the obtained urethane resin by heating to form a three-dimensional network structure is formed into a sheet having a thickness of 2.35 mm, and cut into strips each having a width of 5.5 mm and a length of 245 mm (the length is the minimum length). A double-faced adhesive tape (trade name: No. 5605, manufactured by Nitto Denko Corporation) having a substrate formed from a polyethylene terephthalate (PET) resin having a thickness of 0.05 mm and a width of 3.5 mm is attached to the central region in the width direction of the strip sheet, thereby forming a strip-shape sheet (A6) having an adhesive tape. The strip-shaped sheet (A6) has a region (i.e., unbound region), in which no double-faced adhesive tape is provided, at one end in the width direction thereof, and the width of the unbound region in the width direction of the strip-shaped sheet (A6) is 1.0 mm, and the width of the unbound region is 18% with respect to the whole width of the strip sheet.

One end in the longitudinal direction of the strip-shaped sheet (A6) is attached to a predetermined position of a shaft which has a diameter of 4 mm and is formed from free-cutting steel having electroless nickel plating thereon. The strip-shape sheet (A6) is then wound helically around the shaft so that the angle against the axial direction of the shaft (i.e., the helix angle θ shown in FIG. 2) becomes 20°, by rotating the shaft while the strip-shape sheet (A6) is pulled with tension in the longitudinal direction thereof so as to prevent slack, thereby producing a cleaning element for a charging roll.

The numerical value of "π×r×cos θ" in the relational formula (1) is 5.90, and the width (W) of the strip-shape sheet (A6) is 5.5 mm as mentioned above.

Comparative Example 1

Preparation of Cleaning Element for Charging Roll

A urethane material (trade name: EP70, manufactured by INOAC CORPORATION) obtained by mixing a polyether and an isocyanate and curing the obtained urethane resin by heating to form a three-dimensional network structure is formed into a sheet having a thickness of 2.35 mm A double-faced adhesive tape (trade name: No. 5605, manufactured by Nitta Denko Corporation) having a substrate formed from a polyethylene terephthalate (PET) resin having a thickness of 0.05 mm is attached to the sheet, and the sheet was cut into strips each having a width of 5.5 mm and a length of 232 mm (the length is the minimum length), thereby forming a strip-shaped sheet (B1) having an adhesive tape. The obtained strip-shaped sheet (B1) has the double-faced adhesive tape on the entire surface thereof, which means that the width of the unbound region is 0%.

One end in the longitudinal direction of the strip-shape sheet (B1) is attached to a predetermined position of a shaft which has a diameter of 4 mm and is formed from free-cutting steel having electroless nickel plating thereon. The strip-shape sheet (B1) is then wound helically around the shaft so that the angle against the axial direction of the shaft (i.e., the helix angle θ shown in FIG. 2) becomes 26°, by rotating the shaft while the strip-shape sheet (B1) is pulled with tension in the longitudinal direction thereof so as to prevent slack, thereby producing a cleaning element for a charging roll.

The numerical value of "π×r×cos θ" in the relational formula (1) is 5.64, and the width (W) of the strip-shape sheet (B1) is 5.5 mm as mentioned above.

Evaluation Tests

Measurement of Resistance Value of Charging Roll

The charging roll, any one of the cleaning elements for a charging roll obtained in the Examples and Comparative Example, and a dedicated bearing (made of an electroconductive polyacetal resin (POM)) which controls the amount of engagement (0.25 mm) between the charging roll and the cleaning element are installed in a process cartridge for C3110cn (manufactured by DELL Inc.). The process cartridge is attached to C3110cn (manufactured by DELL Inc.), and a continuous printing test is carried out under the conditions mentioned below.

MIC used: C3110cn manufactured by DELL Inc.

Chart used: an image having a color image density of 20%

Number of sheets traveled: 20,000 sheets (A4)

Traveling environments: an environment of 28° C. and 85% RH for 10,000 sheets, and an environment of 10° C. and 15% RH for 10,000 sheets Scanning is carried out while a voltage of 100 V is applied by a bearing electrode having a width of 5 min at before and after the continuous printing test, and the common logarithms of the resistance values on the two positions in total at 0° and 180° in the circumference direction are measured (the environment for the measurement is an environment of 10° C. and 15% RH) to calculate the resistance difference before and after the traveling (unit: log Ω). The results are shown in the following Table 1.

TABLE 1

| | 0° | 180° | Average |
|---|---|---|---|
| Example 1 | 0.21 | 0.21 | 0.21 |
| Example 2 | 0.05 | 0.07 | 0.06 |
| Example 3 | 0.12 | 0.15 | 0.14 |
| Example 4 | 0.4 | 0.5 | 0.45 |
| Example 5 | 0.2 | 0.16 | 0.18 |
| Example 6 | 0.1 | 0.12 | 0.11 |
| Comparative Example 1 | 0.66 | 0.63 | 0.65 |

As an index indicating the degree of cleaning of the surface of the charging roll by the cleaning element for charging rolls, the change in the resistance of the charging roll is measured as mentioned above. When the amount of the smudge on the surface of the charging roll is large, the resistance becomes high.

It is clear that the rise in the resistance of the charging roll is small and thus the charging roll is cleaned more efficiently in the cases when the cleaning elements for a charging roll of Examples 1, 2, 3, 5 and 6 are used, as compared to Comparative Example 1. Example 4 has a result which is better than Comparative Example and inferior to other examples since, although the cleaning element of Example 4 has an unbound region, the edge thereof is more difficult to function over the entire area of the element to be cleaned, than those in other examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning element for an image-forming apparatus, the cleaning element comprising:

a shaft;

a strip-shaped sheet which is disposed helically on an outer circumferential surface of the shaft; and an adhesive layer which is disposed between the shaft and the strip-shaped sheet and binds the shaft and the strip-shaped sheet, the strip-shaped sheet having, on a surface thereof facing the shaft, an unbound region in which the adhesive layer is absent, at an end in a width direction of the strip-shaped sheet which faces a downstream side in a rotation direction of the shaft.

2. The cleaning element for an image-forming apparatus of claim 1, wherein a width of the unbound region is about 5% or more of a width of the surface of the strip-shaped sheet which faces the shaft.

3. The cleaning element for an image-forming apparatus of claim 1, wherein a width of the unbound region is about 10% or more of a width of the surface of the strip-shaped sheet which faces the shaft.

4. The cleaning element for an image-forming apparatus of claim 1, wherein a width of the unbound region is about 15% or more of a width of the surface of the strip-shaped sheet which faces the shaft.

5. The cleaning element for an image-forming apparatus of claim 1, wherein:

the strip-shaped sheet is disposed on the outer circumferential surface of the shaft so that at least a part of the strip-shaped sheet constantly contacts an element to be cleaned when the strip-shaped sheet cleans a surface of the element to be cleaned by contacting the element to be cleaned while rotating around the shaft; and the cleaning element satisfies the following relational formula (1):

$$W \leqq \pi \times r \times \cos\theta \quad \text{(formula (1))}$$

wherein, in formula (1), θ is an acute angle formed by an intersection between a line running along a center of a width direction of the strip-shaped sheet and an axial direction of the shaft; W is a width of the strip-shaped sheet; and r is a radius of the shaft.

6. The cleaning element for an image-forming apparatus of claim 5, wherein θ is about 45° or less.

7. The cleaning element for an image-forming apparatus of claim 5, wherein θ is about 30° or less.

8. A charging device comprising:

a charging element that charges a material to be charged; and the cleaning element for an image-forming apparatus of claim 1, the cleaning element being disposed in contact with a surface of the charging element and cleaning the surface of the charging element.

9. A process cartridge comprising at least the charging device of claim 8, the process cartridge being attachable to and detachable from an image forming apparatus.

10. An image-forming apparatus comprising:

an image retainer;

the charging device of claim 8, the charging device charging a surface of the image retainer;

a latent image-forming device that forms a latent image on the charged surface of the image retainer;

a developing device that develops the latent image formed on the image retainer using a toner to form a toner image; and a transfer device that transfers the toner image to an object.

* * * * *